US009255491B2

(12) United States Patent
Blaney et al.

(10) Patent No.: US 9,255,491 B2
(45) Date of Patent: Feb. 9, 2016

(54) SURFACE AREA AUGMENTATION OF HOT-SECTION TURBOMACHINE COMPONENT

(75) Inventors: Ken F. Blaney, Middleton, NH (US); Paul M. Lutjen, Kennebunkport, ME (US)

(73) Assignee: United Technologies Corporation, Hartford, CT (US)

( * ) Notice: Subject to any disclaimer, the term of this patent is extended or adjusted under 35 U.S.C. 154(b) by 1029 days.

(21) Appl. No.: 13/399,206

(22) Filed: Feb. 17, 2012

(65) Prior Publication Data

US 2013/0216363 A1 Aug. 22, 2013

(51) Int. Cl.

| | |
|---|---|
| ***F04D 29/58*** | (2006.01) |
| ***F01D 11/24*** | (2006.01) |
| ***F01D 5/18*** | (2006.01) |

(52) U.S. Cl.

CPC ..... *F01D 11/24* (2013.01); *F01D 5/187* (2013.01); *F05D 2240/11* (2013.01); *F05D 2240/127* (2013.01); *F05D 2250/11* (2013.01); *F05D 2250/23* (2013.01); *F05D 2260/2212* (2013.01); *F05D 2260/2214* (2013.01)

(58) Field of Classification Search

CPC ..... F01D 11/08; F01D 11/24; F01D 5/187; F05D 2260/2214; F05D 2260/2212; F05D 2260/22141; F05D 2240/127; F05D 2240/11; F05D 2250/00; F05D 2250/11

USPC ..... 415/173.1, 116, 115

See application file for complete search history.

(56) References Cited

U.S. PATENT DOCUMENTS

| | | | | |
|---|---|---|---|---|
| 4,064,300 | A * | 12/1977 | Bhangu | 428/120 |
| 5,538,394 | A | 7/1996 | Inomata et al. | |
| 5,738,493 | A | 4/1998 | Lee et al. | |
| 5,975,850 | A | 11/1999 | Abuaf et al. | |
| 6,379,528 | B1 | 4/2002 | Lee et al. | |
| 6,607,355 | B2 | 8/2003 | Cunha et al. | |
| 7,553,128 | B2 * | 6/2009 | Abdel-Messeh et al. | 415/173.1 |
| 7,934,906 | B2 | 5/2011 | Gu et al. | |
| 8,016,546 | B2 | 9/2011 | Surace et al. | |
| 2005/0123401 | A1 | 6/2005 | Bunker et al. | |
| 2006/0001182 | A1 | 1/2006 | Kinney, Jr. et al. | |
| 2006/0099073 | A1 | 5/2006 | Djeridane et al. | |
| 2006/0231241 | A1 | 10/2006 | Papapanu et al. | |
| 2008/0063524 | A1 | 3/2008 | Tibbott | |
| 2010/0119372 | A1 | 5/2010 | Gage et al. | |
| 2010/0242488 | A1 | 9/2010 | Veninger et al. | |

(Continued)

FOREIGN PATENT DOCUMENTS

| | | |
|---|---|---|
| EP | 1505257 | 2/2005 |
| EP | 1533475 | 5/2005 |

(Continued)

OTHER PUBLICATIONS

EP Search Report for EP Application No. 13151515.7 mailed on Jul. 10, 2014.

*Primary Examiner* — Craig Kim
*Assistant Examiner* — Maxime Adjagbe
(74) *Attorney, Agent, or Firm* — Carlson, Gaskey & Olds, P.C.

(57) ABSTRACT

An example turbomachine hot-section component protrusion extends away from a base surface of a hot-section component along a longitudinal axis. A radial cross-section of the protrusion has a profile that is non-circular.

20 Claims, 4 Drawing Sheets

(56) References Cited

U.S. PATENT DOCUMENTS

| | | | |
|---|---|---|---|
| 2011/0033311 | A1 | 2/2011 | Martin et al. |
| 2011/0143292 | A1 | 6/2011 | Collier |

FOREIGN PATENT DOCUMENTS

| | | |
|---|---|---|
| EP | 1676981 | 7/2006 |
| EP | 1914390 | 4/2008 |

* cited by examiner

SURFACE AREA AUGMENTATION OF HOT-SECTION TURBOMACHINE COMPONENT

BACKGROUND

This disclosure relates generally to a surface area augmentation feature and, more particularly, to a protrusion-type surface augmentation feature extending from a hot-section turbomachine engine component and having a non-circular cross section.

Turbomachines, such as gas turbine engines, typically include a fan section, a turbine section, a compressor section, and a combustor section. The fan section drives air along a core flow path into the compressor section. The compressed air is mixed with fuel and combusted in the combustor section. The products of combustion are expanded in the turbine section. Hot sections of the turbomachine are exposed to very high temperatures during operation. Cooling these areas of the engine is often difficult.

Some surfaces of hot-section turbomachine engine components include surface area augmentation features. Typical features include cylindrical posts having circular cross-sections and spherical tops.

SUMMARY

A turbomachine hot-section component protrusion according to an exemplary aspect of the present disclosure includes, among other things, a protrusion that extends away from a base surface of a hot-section component along a longitudinal axis. A radial cross-section of the protrusion has a profile that is non-circular.

In a further non-limiting embodiment of the foregoing turbomachine hot-section component embodiment, the profile may include at least three edges that are not curved.

In a further non-limiting embodiment of either of the foregoing turbomachine hot-section component embodiments, the at least three edges may each be spaced an equal distance from the axis.

In a further non-limiting embodiment of any of the foregoing turbomachine hot-section component embodiments, the profile may have a triangular shape.

In a further non-limiting embodiment of any of the foregoing turbomachine hot-section component embodiments, the profile may comprise at least four edges that are not curved.

In a further non-limiting embodiment of any of the foregoing turbomachine hot-section component embodiments, the at least four edges may each be spaced an equal distance from the axis.

In a further non-limiting embodiment of any of the foregoing turbomachine hot-section component embodiments, the profile may have a rectangular shape.

In a further non-limiting embodiment of any of the foregoing turbomachine hot-section component embodiments, the radial cross-section of the protrusion may be parallel to the surface.

In a further non-limiting embodiment of any of the foregoing turbomachine hot-section component embodiments, the protrusion may include at least three distinct planar surfaces facing radially outward.

In a further non-limiting embodiment of any of the foregoing turbomachine hot-section component embodiments, the protrusion may include at least one planar surface facing axially away from the base surface.

In a further non-limiting embodiment of any of the foregoing turbomachine hot-section component embodiments, the turbomachine hot-section component may include radii that transition one of the at least three distinct planar surfaces into another of the at least three distinct planar surfaces.

A turbomachine component according to another exemplary aspect of the present disclosure comprises a surface of a component that is located in a hot-section of a turbomachine, and an array of protrusions extending along a longitudinal axis away from the surface. Each of the protrusions has a radial cross-section having a non-circular profile.

In a further non-limiting embodiment of any of the foregoing turbomachine component embodiments, the non-circular profile may include at least three edges that are not curved.

In a further non-limiting embodiment of any of the foregoing turbomachine component embodiments, the surface may be a blade outer air seal surface, and the array of protrusions may extend into a cavity of the blade outer air seal. Additionally or alternatively, the surface may be a combustor surface.

A method of augmenting a surface area of a turbomachine hot-section component according to another exemplary aspect of the present disclosure includes, among other things, increasing a surface area of a turbomachine hot-section component using an array of protrusions. The protrusions extend longitudinally along an axis away from a base surface of a hot-section component, and each of the protrusions has a radial cross-section having a profile that is non-circular.

In a further non-limiting embodiment of the foregoing method of augmenting a surface area of a turbomachine hot-section component, the radial cross-section may include three distinct linear portions.

In a further non-limiting embodiment of either of the foregoing method of augmenting a surface area of a turbomachine hot-section component, the radial cross-section may include four distinct linear portions.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
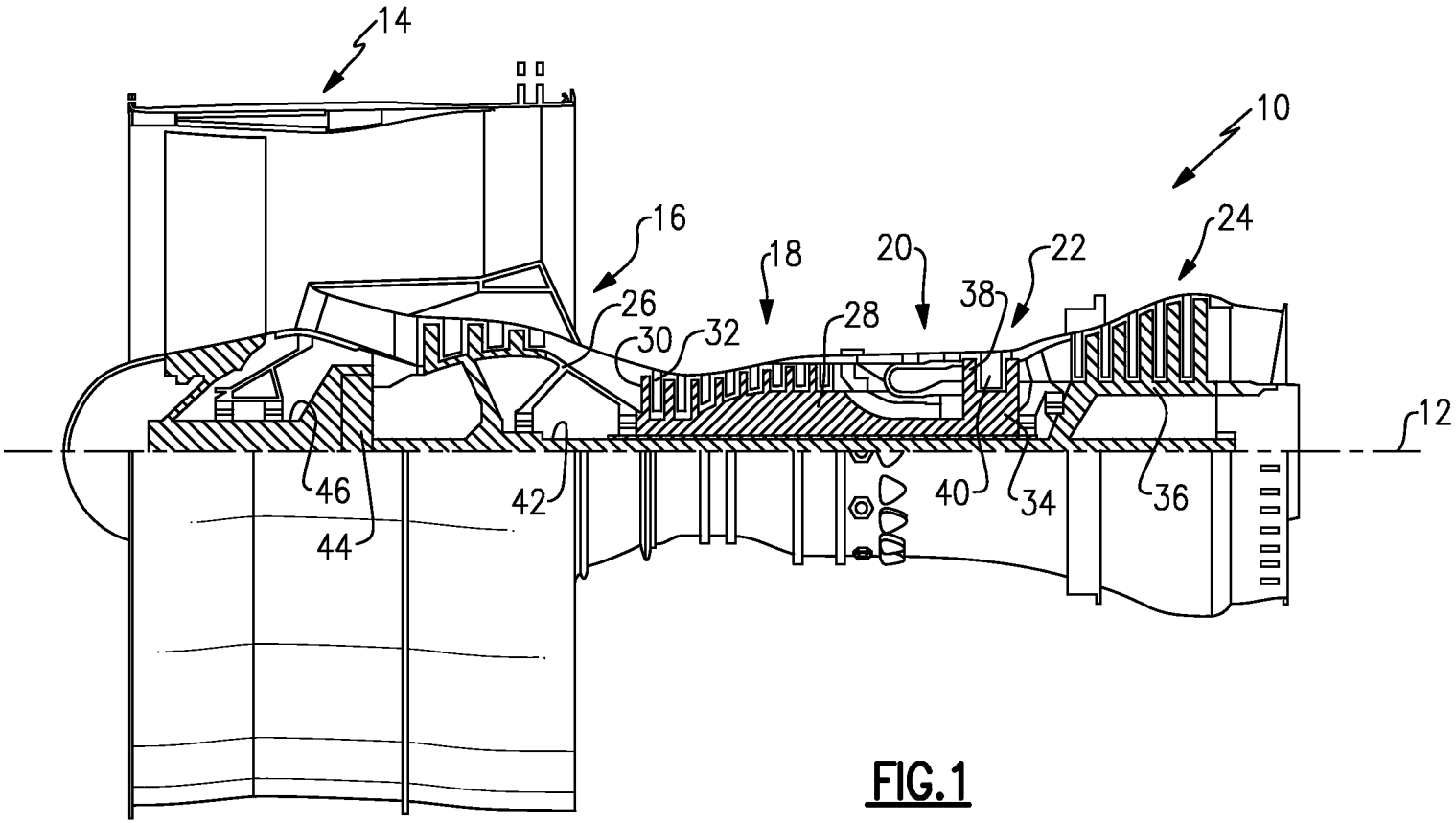
FIG. 1 shows a section view of an example turbomachine.

Referring to FIG. 1, an example turbomachine, such as a gas turbine engine 10, is circumferentially disposed about an axis 12. The gas turbine engine 10 includes a fan section 14, a low-pressure compressor section 16, a high-pressure compressor section 18, a combustion section 20, a high-pressure turbine section 22, and a low-pressure turbine section 24. Other example turbomachines may include more or fewer sections.

During operation, air is compressed in the low-pressure compressor section 16 and the high-pressure compressor section 18. The compressed air is then mixed with fuel and burned in the combustion section 20. The products of combustion are expanded across the high-pressure turbine section 22 and the low-pressure turbine section 24.

The low-pressure compressor section 16 and the high-pressure compressor section 18 include rotors 26 and 28, respectively, that rotate about the axis 12. The high-pressure compressor section 18 and the low-pressure compressor section 16 also include alternating rows of rotating airfoils or rotating compressor blades 30 and static airfoils or static vanes 32.

The high-pressure turbine section 22 and the low-pressure turbine section 24 include rotors 34 and 36, respectively, which rotate in response to expansion to drive the high-pressure compressor section 18 and the low-pressure compressor section 16. The high-pressure compressor section 18 and the low-pressure compressor include alternating rows of rotating airfoils or rotating compressor blades 38 and static airfoils or static vanes 40.

In this example, rotating the rotor 36 drives a shaft 42 that provides a rotating input to a geared architecture 44. The example geared architecture 44 drives a shaft to rotate fan 46 of the fan section 14. The geared architecture 44 has a gear ratio that causes the fan 46 to rotate at a slower speed than the shaft 42.

The examples described in this disclosure are not limited to the two-spool gas turbine architecture described, however, and may be used in other architectures, such as the single spool axial design, a three-spool axial design, and still other architectures. That is, there are various types of gas turbine engines, and other turbomachines, that can benefit from the examples disclosed herein.

Figure 2:
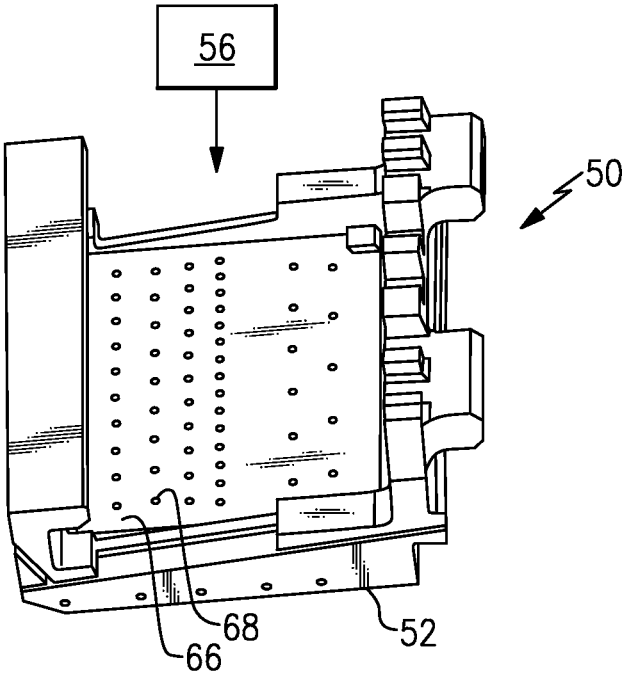
FIG. 2 shows a perspective view of an example blade outer air seal assembly.
Figure 3:
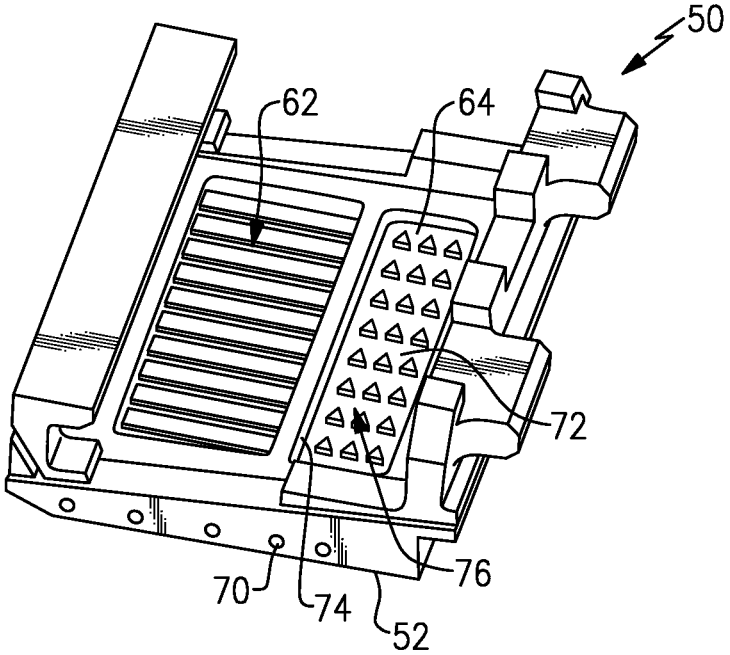
FIG. 3 shows a perspective view of the FIG. 2 blade outer air seal with an exposed inner cavity.

Referring to FIGS. 2 and 3 with continuing reference to FIG. 1, an example blade outer air seal 50 is arranged circumferentially about the blades 38 of the high-pressure turbine section 22. The blade outer air seal 50 includes a predominantly cylindrical sealing surface 52 proximate to the tip of the blades 38. During rotation of the high-pressure turbine section rotor, the surface 52 creates a seal with the blades 38.

During operation, the blade outer air seal 50 is exposed to significant thermal energy. Cooling air 56, such as bleed air from the engine 10, is moved into cavities 62 and 64 within the blade outer air seal 50 to cool the blade outer air seal 50. The blade outer air seal 50 is considered a hot-section component of the engine 10 due to its exposure to the hot gas flow path of the engine 10. The blade outer air seal 50 is an investment cast component in this example. The blade outer air seal 50 typically requires the use of parasitic cooling air to meet its life requirements. The blade outer air seal 50 is considered a hot section part because it requires the cooling air. Other hardware requiring cooling flow is considered a hot section part. Furthermore, adjacent or supporting hardware or other hardware that directs or delivers cooling air may also be considered hot section parts.

In this example, an impingement plate 66 covers the cavities 62 and 64. The cooling air 56 moves through apertures 68 in the impingement plate 66 to the cavities 62 and 64. The air exits the cavities 62 and 64 through apertures 70 in the blade outer air seal 50.

A floor surface 72 and sidewalls 74 establish portions of the cavity 64. An array of protrusions 76 extend from the floor surface 72 of the blade outer air seal 50. The floor surface 72 of the blade outer air seal 50 is considered a base surface of a hot-section component in this example.

The array of protrusions 76 are surface area augmentation features that effectively increase the surface area of the blade outer air seal 50 interacting with air moving through the cavity 64. The array of protrusions 76 thus facilitates thermal energy transfer from the blade outer air seal 50 to the air moving through the cavity 64.

Figure 4:
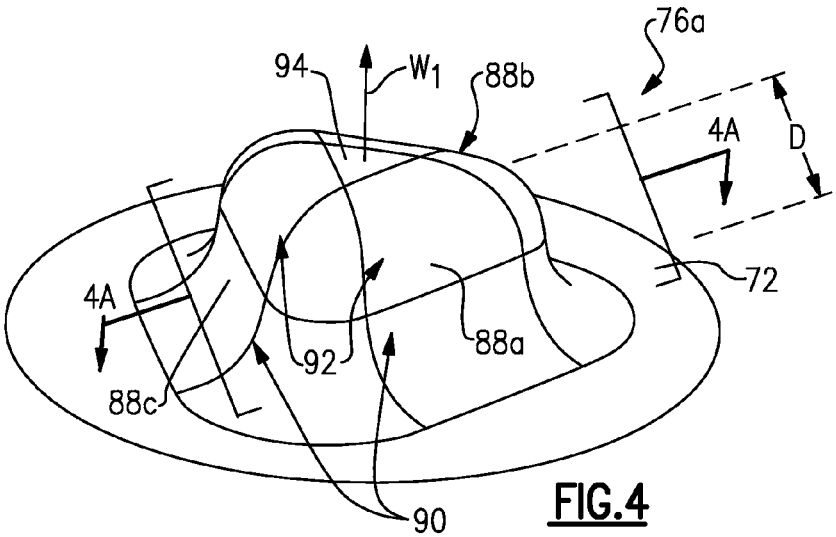
FIG. 4 shows a protrusion positioned on a surface of the FIG. 3 blade outer air seal.
Figure 4A:
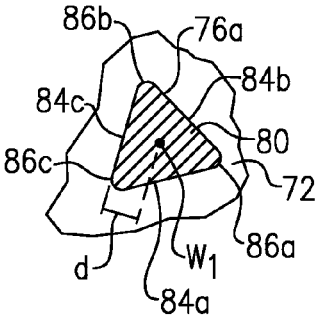
FIG. 4A shows a section view at line 4A-4A in FIG. 4.

Referring to FIGS. 4 and 4A with continuing reference to FIG. 3, an example one of the protrusions 76A within the array of protrusions 76 extends longitudinally along an axis $W_1$ away from the floor surface 72. A radial cross-section 80 of the protrusion 76*a* has a profile that is noncircular. The radial cross-section 80 is parallel to the floor surface 72 and perpendicular to the axis $W_1$ in this example.

In this example, the profile includes three edges 84*a*-84*c* that are not curved. That is, the edges 84*a*-84*c* are linear. In this example, each of the edges 84*a*-84*c* is spaced an equal distance d from the axis $W_1$. In other examples, some of all of the edges 84*a*-84*c* are not equally spaced from the axis $W_1$.

Also, in this example, a radiused area 86*a* transitions the edge 84*a* to the edge 84*b*, a radiused area 86*b* transitions the edge 84*b* to the edge 84*c*, and a radiused area 86*c* transitions the edge 84*c* to the edge 84*a*.

The protrusion 76*a* includes three sides 88*a*-88*c* facing outwardly away from the axis $W_1$. The sides 88*a*-88*c* are not planar. Concave portions 90 transition the floor surface 72 into convex portions 92. The convex portions 92 transition the concave portions 90 into a planar portion 94. The planar portion 94 has a triangular shape and is parallel to the floor surface 72 in this example.

In one specific example, the concave portions 90 and the convex portions 92 have a 0.015 inch radius (0.381 mm), and a distance D from the floor surface 72 to the top surface 94 is 0.030 inches (0.762 mm). Thus, the protrusion 76*a* can be said to have a height of 0.030 inches (0.762 mm). The total surface area of the protrusion 76*a* is about 0.0029 inches$^2$ (1.871 mm$^2$).

Although the example array of protrusions 76 is shown in the blade outer air seal 50, many other components of the engine 10 could benefit from the use the array of the protrusions 76. For example, the combustor panels in the combustion section could also benefit from the increased surface area provided by the array of protrusions 76.

In this example, all the protrusions 76*a* in the array of protrusions 76*a* are shaped similarly to the protrusion 76*a*. In other examples, some or all of the protrusions in the array of protrusions 76*a* have different shapes.

Figure 5A:
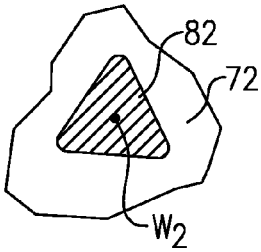
FIG. 5A shows a section view at line 5A-5A in FIG. 5.
Figure 5:
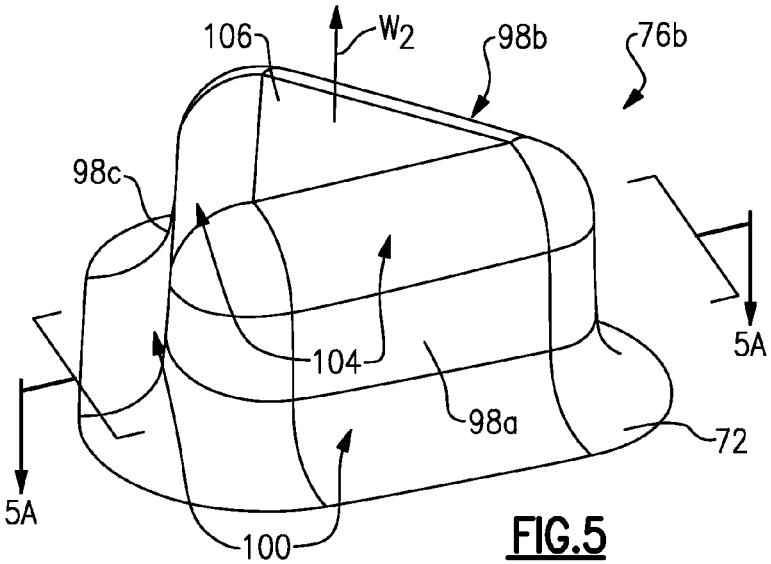
FIG. 5 shows another example protrusion suitable for placement on the surface of the FIG. 3 blade outer air seal.

For example, another example protrusion 76*b* suitable for use within the array of protrusions 76 instead of, or in addition to, other protrusions is shown in FIGS. 5-5A. The protrusion 76*b* includes a radial cross-section 82 similar to the radial cross-section 80 of the protrusion 76*a*. Notably, the protrusion 76*b* includes planar side walls 98*a*-98*c* each positioned radially the same distance from the axis $W_2$.

The protrusion 76*b* includes concave portions 100 transitioning the floor surface 72 into the side walls 98*a*-98*c*, and convex portions 104 transitioning the side walls 98*a*-98*c* to a planar top surface 106. The example top surface 106 is planar, has a triangular profile, and is parallel to the floor surface 72. The example protrusion 76*b* has a total surface area of 0.0035 inches$^2$ (2.258 mm$^2$).

Figure 6:
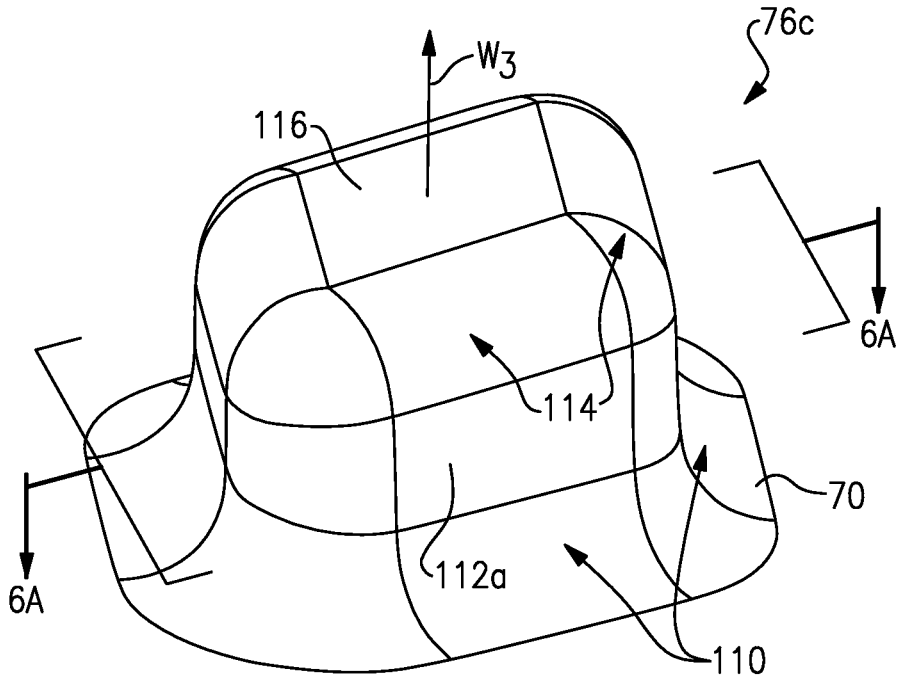
FIG. 6 shows yet another example protrusion suitable for placement on the surface of the FIG. 3 blade outer air seal.
Figure 6A:
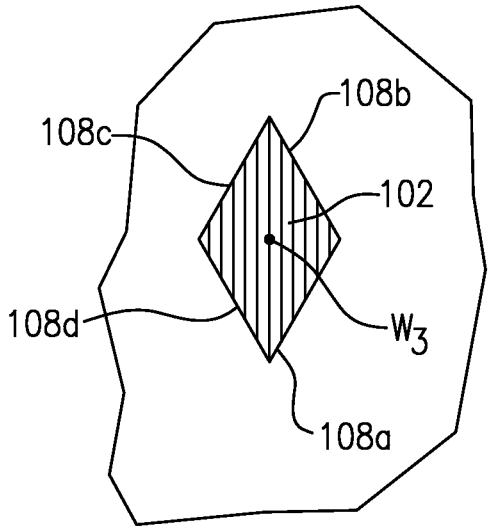
FIG. 6A shows a section view at line 6A-6A in FIG. 6.

Yet another example protrusion 76*c* suitable for use within the array of protrusions 76 instead of, or in addition to, other protrusions is shown in FIGS. 6-6A. The protrusion 76*c* has a rectangular or diamond-shaped radial profile 102. In this example, the radial profile 102 of the protrusion 76*c* is generally rhombic. The radial profile 102 is square in other examples.

The profile 102 of the example protrusion 76*c* includes four noncurved (or linear) sides 108*a*-108*d*. Each of the sides 108*a*-108*d* is positioned the same distance away from the axis $W_3$. Radial portions transition the sides of the profile into one another.

The protrusion 76*c* includes concave portions 110 transitioning the floor surface 72 into respective side walls 112*a*-112*d*. The protrusion 76*c* includes convex portions 114 transitioning the side walls 112*a*-112*d* to a planar portion 116. The planar portion 116 is has a square profile and is parallel to the floor surface 72 in this example. In other examples, the planar portion 116 is not parallel to the floor surface 72. The total surface area of the protrusion 76*c* is 0.0038 inches$^2$ (2.452 mm$^2$) in this example.

The example protrusions 76*a*, 76*b*, and 76*c* may be used alone or in combination within the array of protrusions 76. Other example protrusions could also be used.

Features of the disclosed examples include a protrusion having an increased surface area for transferring thermal energy away from a hot-section component. The protrusion is a type of surface area augmentation feature.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A turbomachine hot-section component protrusion, comprising:

a protrusion that extends away from a base surface of the hot-section component along a longitudinal axis, wherein a radial cross-section of the protrusion has a profile that is non-circular, wherein the protrusion includes at least one planar surface facing axially away from the base surface and at least three distinct planar surfaces facing away from the axis, the protrusion including radii that transition the at least one planar surface facing axially away from the base surface into the at least three distinct planar surfaces facing away from the axis.

2. The turbomachine hot-section component of claim 1, wherein the profile comprises at least three edges that are not curved.

3. The turbomachine hot-section component of claim 2, wherein the at least three edges are each spaced an equal distance from the axis.

4. The turbomachine hot-section component of claim 1, wherein the profile has a triangular shape.

5. The turbomachine hot-section component of claim 1, wherein the profile comprises at least four edges that are not curved.

6. The turbomachine hot-section component of claim 5, wherein the at least four edges are each spaced an equal distance from the axis.

7. The turbomachine hot-section component of claim 1, wherein the profile has a rectangular shape.

8. The turbomachine hot-section component of claim 1, wherein the radial cross-section of the protrusion is parallel to the surface.

9. The turbomachine hot-section component of claim 1, wherein the base surface is a blade outer air seal surface, and the protrusion is configured to extends into a cavity of the blade outer air seal.

10. The turbomachine hot-section component of claim 1, wherein the at least one planar surface facing axially away from the base surface is configured to face toward an impingement plate that provides apertures to direct air toward the at least one planar surface facing axially away from the base surface.

11. A turbomachine component, comprising:

a surface of a component that is located in a hot-section of a turbomachine;

an array of protrusions extending along a longitudinal axis away from the surface, wherein each of the protrusions has a radial cross-section having a non-circular profile, wherein each of the protrusions includes at least one planar surface facing axially away from the surface of the component and at least three distinct planar surfaces facing away from the axis, wherein each of the protrusions includes radii that transition the at least one planar surface facing axially away from the surface of the component into the at least three distinct planar surfaces facing away from the axis; and an impingement plate axially spaced from the array of protrusions, the impingement plate providing apertures that direct air toward the array of protrusions in a direction that is aligned with the longitudinal axis.

12. The turbomachine component of claim 11, wherein the non-circular profile includes at least three edges that are not curved.

13. The turbomachine component of claim 11, wherein the surface is a blade outer air seal surface, and the array of protrusions extend into a cavity of the blade outer air seal.

14. The turbomachine component of claim 11, wherein the surface is a combustor surface.

15. A method of augmenting a surface area of a turbomachine hot-section component, comprising:

increasing a surface area of a turbomachine hot-section component using an array of protrusions, wherein the protrusions each extends longitudinally along an axis away from a base surface of the hot-section component, and each of the protrusions has a radial cross-section having a profile that is non-circular, each of the protrusions including radii that transition at least one planar surface facing axially away from the base surface into one of at least three distinct planar surfaces facing away from the axis.

16. The method of claim 15, wherein the radial cross-section includes three distinct linear portions.

17. The method of claim 16, wherein the radial cross-section includes four distinct linear portions.

18. The method of claim 16, wherein the array of protrusions extend from the base surface into a cavity of a blade outer air seal.

19. The method of claim 18, further comprising directing air through a plurality of apertures in an impingement plate toward the at least one planar surface facing axially away from the base surface.

20. The method of claim 19, wherein flow through the apertures is in a direction that is aligned with the axis.

* * * * *